United States Patent [19]

Sickler

[11] 4,100,703

[45] Jul. 18, 1978

[54] AWNING ASSEMBLY

[76] Inventor: Raymond W. Sickler, R.D. 2, Wellsburg, N.Y. 14894

[21] Appl. No.: 770,791

[22] Filed: Feb. 22, 1977

[51] Int. Cl.[2] ..... E04D 13/08

[52] U.S. Cl. ..... 52/16; 52/73; 52/467; 52/397; 52/729

[58] Field of Search ..... 52/73–75, 52/726, 729, 397, 398, 16, 467; 249/18

[56] References Cited

U.S. PATENT DOCUMENTS

| | | | |
|---|---|---|---|
| 2,701,397 | 2/1955 | Taylor | 52/75 |
| 2,711,138 | 6/1955 | Hart | 52/467 |
| 3,084,479 | 4/1963 | Struben | 52/73 |
| 3,286,413 | 11/1966 | Wells | 52/16 |
| 3,606,418 | 9/1971 | Buker et al. | 52/726 |
| 3,899,152 | 8/1975 | Avery | 249/18 |
| 4,034,957 | 7/1977 | Cody | 249/18 |

FOREIGN PATENT DOCUMENTS

| | | | |
|---|---|---|---|
| 641,372 | 1964 | Belgium | 52/467 |
| 6,617,750 | 1967 | Netherlands | 52/467 |
| 650,239 | 2/1951 | United Kingdom | 52/463 |

*Primary Examiner*—James L. Ridgill, Jr.

[57] ABSTRACT

An awning assembly for use with mobile homes which can accommodate a wide variety of terrains. The assembly includes a plurality of anchored adjustable support posts connected to a plurality of panel joining ribs by captive lock nut assemblies. The nut assemblies permit adjustment of the support elements. The frame structural elements are preferably aluminum extrusions, and the awning panels are of the thermal barrier type having a sandwich-like construction.

7 Claims, 7 Drawing Figures

AWNING ASSEMBLY

BACKGROUND OF THE INVENTION

The present invention relates in general to roofs, and more particularly, to roofs for patios and porches.

As society becomes more mobile, motor homes, house trailers, campers and the like attain great popularity. Often, these devices can be used as permanent abodes, as well as mobile homes.

When a mobile home is to remain in one place for an extended period of time, it is often desirable to erect an awning or the like to provide cover for an area adjacent the mobile home which serves as a porch, patio, or the like. Such an awning should be easy and quick to erect, as well as to disassemble.

There are many awnings presently on the market which can be used in conjunction with mobile homes. However, all of these awnings suffer common deficiencies. The main drawback to these known devices is the difficulty of erecting them, especially if the awning must be set up on uneven terrain. Thus, a difficult erection process is made more difficult due to the lack of versatility of the known awnings.

The awning embodying the present invention is easily set up and can accommodate a wide range of terrain conditions.

SUMMARY OF THE INVENTION

The awning embodying the present invention is easily set up and can be set up to accommodate a variety of different terrains.

The awning assembly comprises a plurality of anchored adjustable support posts which support a plurality of awning panels via a spanner element. Side trim and a gutter system border the awning and a back rail attaches the awning to the mobile home.

The panels are connected together by rib joining members which are shaped to form channels beneath the awning panels. The channels receive fasteners, such as bolts, in a free sliding manner to connect the awning panels to the support memebers. The side trim also has channel forming members which also receive fastener members in free sliding engagement. Once the fasteners are slidingly moved into the proper position, they are securely tightened to connect elements together.

The free sliding engagement of the fasteners produces a captive nut assembly which permits easy and quick erection of the awning assembly. By adjusting the height of the support posts, the slope of the awning can be selected. The captive nut assembly permits the nuts of the fastener to be positioned at any suitable longitudinal location along the rib joints, and hence along the awning. In this manner, variations in terrain can be accommodated by moving the support posts toward or away from the mobile home, and suitably adjusting the height of these posts. Furthermore, the slope of the awning can also be adjusted. The captive nut assembly thereby provides an advantage of expeditious assembly to the awning embodying the teachings of the present invention, which advantage is not present in known awning assemblies.

The frame primary supporting members preferably are aluminum extrusions designed and alloyed to obtain maximum support strength. The awning panels are preferably thermal barrier awning roof panels which comprise a sandwich like construction having a polystyrene core and a polyethelyne skin bonded to the core on both top and bottom surfaces thereof.

It is here noted that the terms "top", "bottom", "side", and the like, refer to the awning in the installed orientation.

Other advantages of the awning embodying the teachings of the present invention include: a virtual elimination of underside condensation; great snow weight bearing capacity as compared to known assemblies, especially at low temperatures; and reduced thermal transmission as compared to known assemblies.

The insulating feature of the present awning panels provided by the sandwich-like construction makes the present awning assembly ideal for patio awnings, enclosures, and porches for mobile/modular homes, as well as for other home constructions. The aluminum extrusion of the support elements produces an assembly which is virtually maintenance free.

The gutter system is easily installed and can be easily and accurately aligned due to the captive nut assembly, and has extension joiner members for varying the longitudinal extent thereof. The downspout system is easily assembled and includes snap-fitting elements so that the downspout system can be expeditiously assembled.

Feature strips are added to the awning trim and/or gutter system to enhance the attractiveness of the awning assembly. The feature strips are easily changed to provide a means for varying the overall appearance of the assembly.

OBJECTS OF THE INVENTION

It is a main object of the present invention to provide an awning assembly which is versatile.

It is another object of the present invention to provide an awning assembly which is easily erected and disassembled.

A further object of the present invention is to provide an awning assembly which can accommodate a wide variety of terrains.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
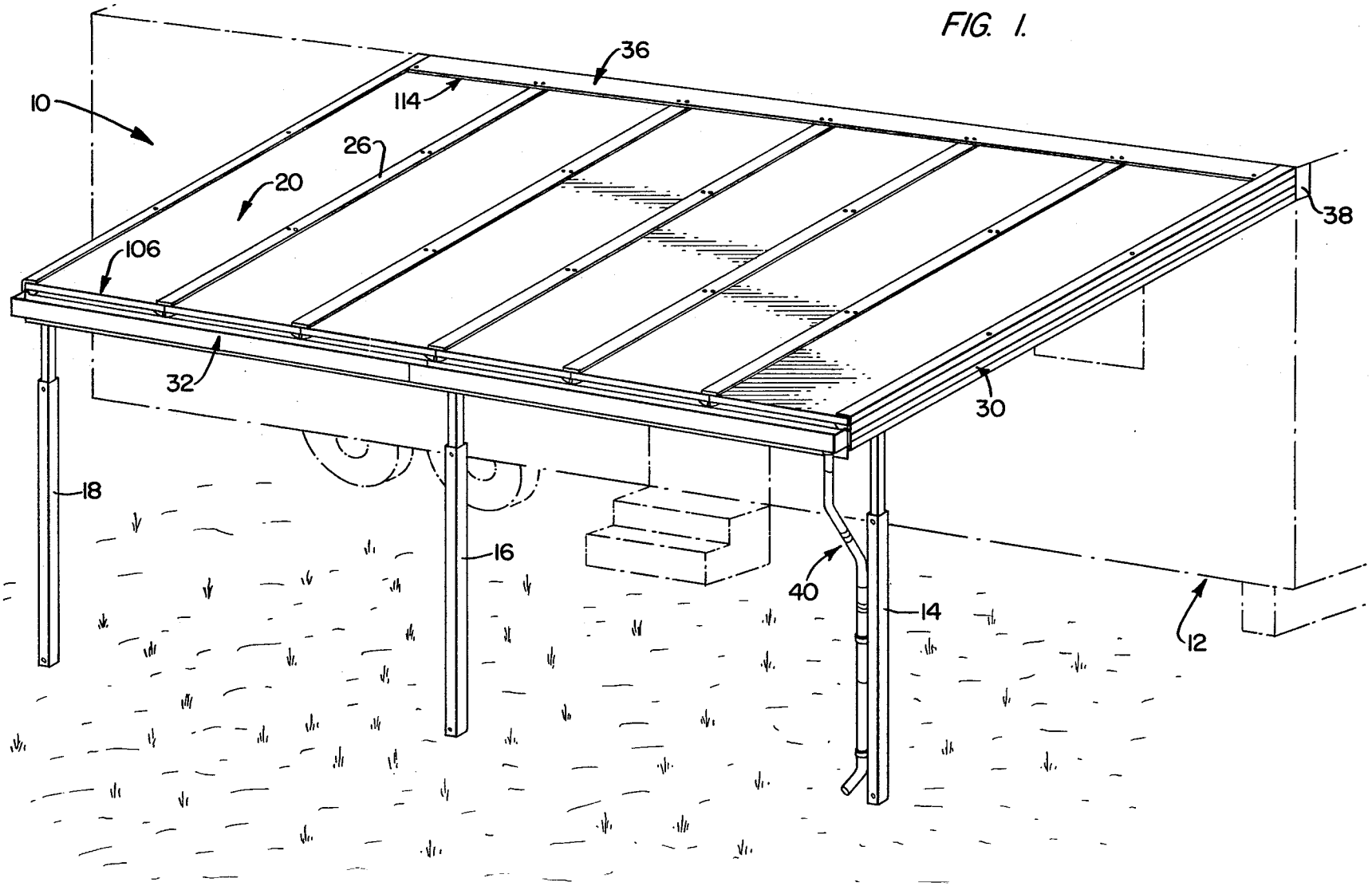
FIG. 1 is a perspective assembled view of the assembly embodying the teachings of the present invention.

Shown in FIG. 1 is an awning assembly 10 for use with an abode, such as a house trailer 12, or the like. The assembly 10 can also be used in conjunction with other devices, such as motor homes, or even permanent structures.

The awning is supported on one side of the abode by a plurality of adjustable support posts 14, 16 and 18 embedded or otherwise mounted in the ground. The awning includes a plurality of panels 20 interconnected by a plurality of connecting means, such as joining ribs 26, located on the lateral side edges of adjacent panels. Side trim 30 and a front mounted gutter 32 border three sides of the outer periphery of the awning with the fourth side being attached to the abode by an elongate, flashing-like mounting rail 36 which is connected to the abode via No. 10 × 1½inch metal screws every 4 inches and sealed by backing strip 38. The gutter includes a quick-assembly downspout system 40 attached to the post 14. The panels 20 are of sandwich-like construction having a core C and a pair of outer layers 41 attached thereto.

The awning assembly is quickly and easily erected and will be described in greater detail below with reference to FIGS. 2–6.

Figure 2:
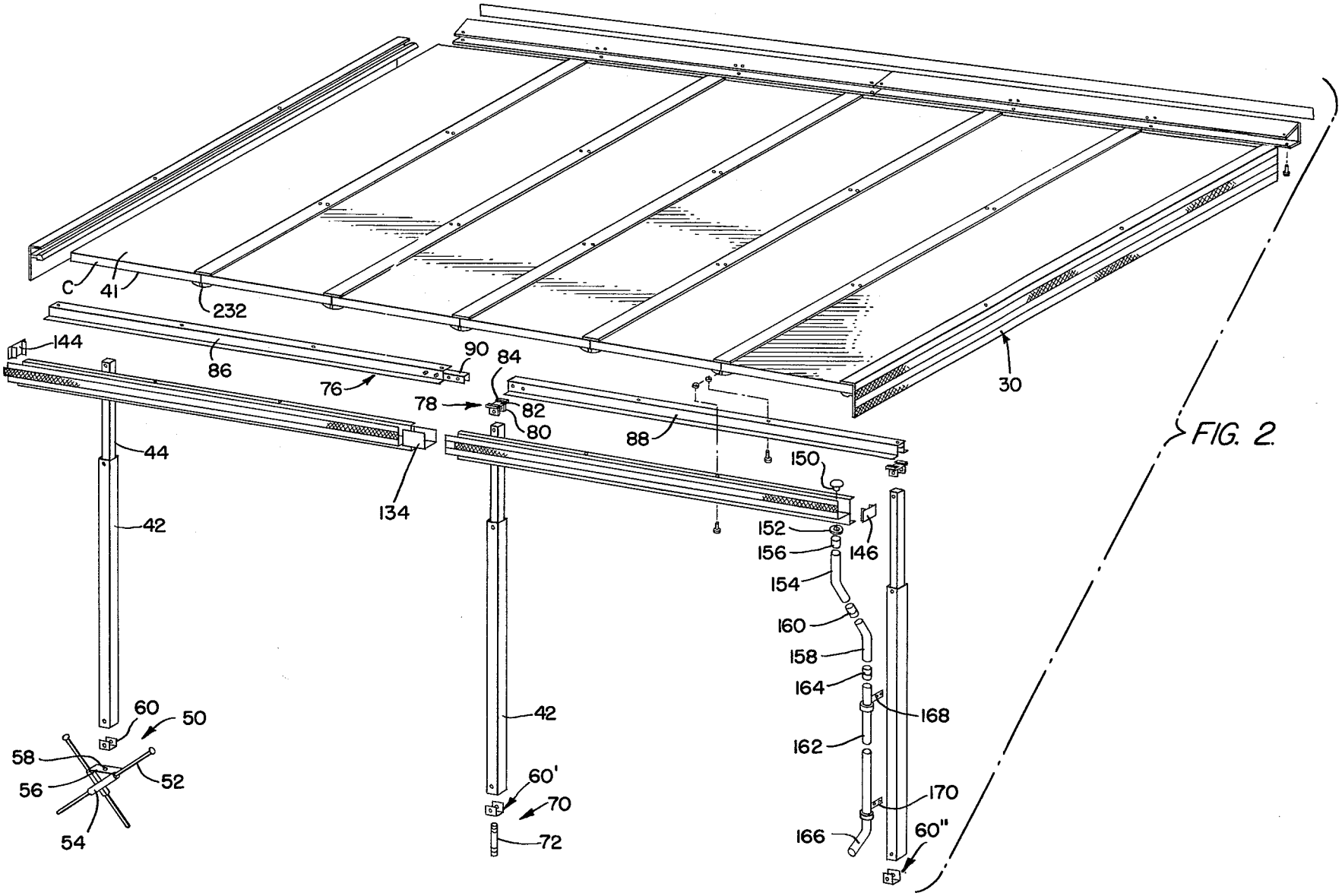
FIG. 2 is an exploded perspective view of the awning assembly embodying the teachings of the present invention.

As shown in FIG. 2, the support posts each include a first section 42 telescopingly receiving a second section 44 at one end while being connected to one of a plurality of ground embedded anchor members at the other end. Fastening members, such as self-tapping screws, or the like, interconnect the first and second post sections. Once the posts are extended to the length required to support the awning at the desired height, the fasteners are set. As will be later discussed, the extension of the posts is used to provide one height adjustment which, in conjunction with other height adjustment means, not only sets the desired awning height, but compensates for terrain irregularities and sets desired awning slope.

As shown in FIG. 2, the anchor member can assume various forms, such as a ground anchor 50, which includes a pair of crossed spikes 52 coupled together by an X-shaped sleeve 54 and a cross brace 56 having a hole 58 defined therein to have the longitudinal axis thereof oriented upright with respect to the ground. An anchor clip 60 has one of a pair of upright wings on each end of a base section and holes defined in the wings and base section to receive appropriate fasteners for fastening the clip 60 to the bottom of post section 42 and to the cross brace 56 to be connected thereby to the ground anchor 50.

A concrete anchor 70 can also be used where appropriate and includes an anchor stub 72 which has threaded ends. One end of the stub is embedded in the concrete, and the other end projects outwardly therefrom to threadably engage an anchor clip 60′ at a threaded hole defined in a base thereof. Again, holes defined in the wings of the clip 60′ receive screws, or like fasteners, to couple the post section 42 to the anchor member.

Alternatively, the anchor clip 60″ alone can be used to mount the post onto the ground. The clip 60″ only has holes defined in the wings thereof for receiving fasteners to couple the post to the clip. The post, therefore, rests on the surface without being connected thereto.

The posts are connected to an adjustable spanner 76 by post top clips 78. The clips 78 include a pair of legs 80 depending from a base 82 which has channel defining lips 84 on the lateral edges thereof. Holes defined in the legs receive fasteners to connect the clips 78 to the top of the posts with the channels defined by lips 84 being upwardly presented and horizontally oriented.

The spanner 76 has a pair of sections 86 and 88 which are U-shaped in transverse cross-section and are connected together by a joiner member 90. Aligned openings on the sides of the spanner sections and in the joiner member receive fasteners to couple the spanner sections together via the joiner member.

Figure 5:
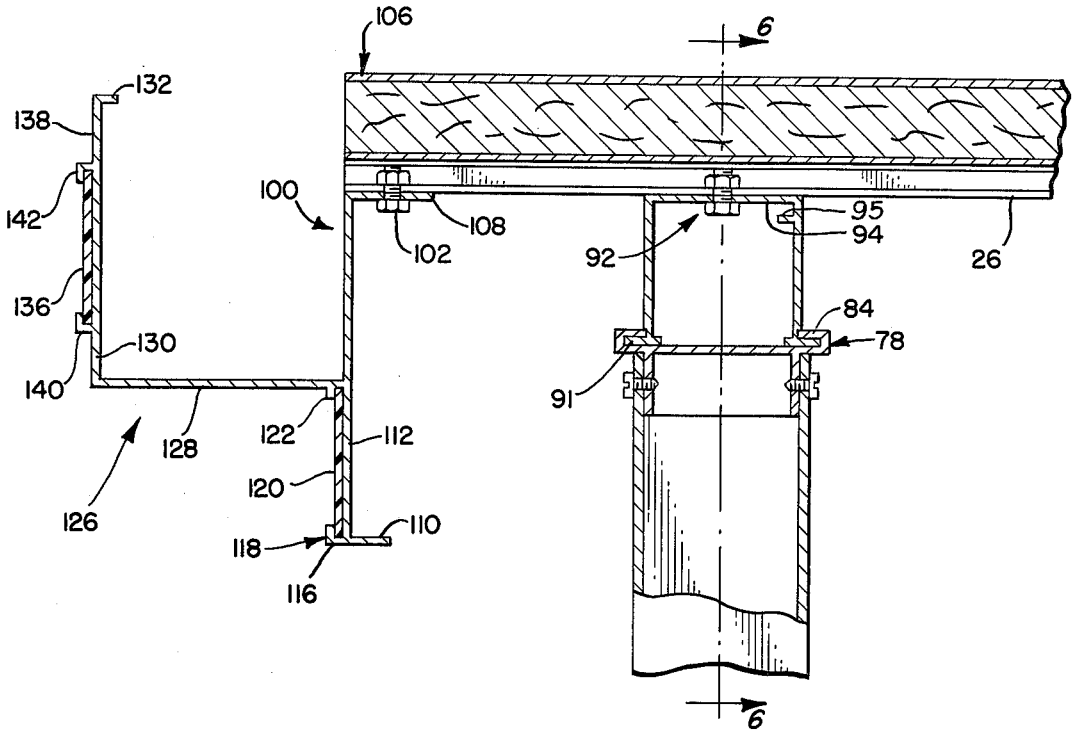
FIG. 5 is a side elevation of a front edge detail of the awning assembly embodying the teachings of the present invention.

As shown in FIG. 5, the U-shaped spanner sections have outwardly presented flanges 91 located on the lower terminal edges of the sections to extend longitudinally of the sections. The width and thickness of the flanges 91 is selected to produce a snug fit between the flanges and the channel defining lips 84 of the clips 78. In this manner, the spanner is securely mounted on the posts and is supported thereby. As the spanner sections need only be slipped into the channels defined on the clips 78, assembly of this portion of the awning 10 is expeditious. As will be discussed later, a further fastener, such as a bolt 92, couples the spanner top 94 to the joining rib 26, and hence couples the joining rib to the support post via the spanner and top clip 78. Further flanges 95 extend longitudinally of the spanner elements.

The spanner serves as a front support channel and can be relocated on the assembly at any time without damaging the elements or plugging holes.

The gutter system 32 is also shown in FIGS. 2 and 5 to include a mounting bracket 100 pendantly supported from the front of the awning by fasteners, such as bolts 102 connected to the joining ribs 26. The mounting bracket forms an elongate skirt-like extension depending from the awning front 106 and includes a pair of rearwardly presented flanges 108 and 110 each located on the lateral sides of a central web 112. It is here noted that "front" and "rear" are taken with reference to the awning front 106 and rear 114 as depicted in the assembled view shown in FIG. 1. To accommodate the fastener 102, the flange 108 is the top flange when the bracket is mounted on the ribs 26, and is longer than flange 110 which is the bottom flange when the bracket is mounted on the ribs 26. A forwardly presented flange 116 is coplanar with bottom flange 110 and extends outwardly of web 112 to form a shelf-like cuff 118 in front of the bracket 100 at the bottom thereof.

The feature strip 120 is seated in the cuff 118 and provides decoration for the awning. A further catch 122 supports the top of the feature strip 120.

A gutter trough 126 is formed by an elongate bottom forming strip 128 attached at one longitudinal edge thereof to the front of the bracket web portion and extending outwardly therefrom, and an elongate side forming strip 130 attached at one longitudinal edge thereof to the other longitudinal edge of the bottom strip 128 and extending upwardly therefrom. The front strip is, therefore, in spaced parallelism with the bracket web portion 112. An elongate flange is connected to the other edge of the front strip to form a top lip 132 of the gutter trough.

The gutter system includes a plurality of gutter segments connected together by joiner members 134, each of which has a U-shape and is sized to fit within the U-shaped gutter troughs.

Due to the slope of the awning, as produced by the height of the supporting posts relative to the height of the rear of the awning, water drains from the awning into the gutter trough. The trough is longitudinally tilted to drain that water into the downspout 40 in the usual manner.

A further feature strip 136 is mounted on the front surface 138 of the side strip 130 by cuff forming clips 140 and 142 attached to the strip surface 138.

As best shown in FIG. 2, the trough has end closure clips 144 and 146 on the ends thereof with downspout system 40 connected thereto adjacent end clip 146. The end clips are shaped and sized to be wedged into the trough to be held by the wedging engagement tightly enough to prevent water escaping out of the ends of the gutter system.

As shown in FIG. 2, the downspout system 40 is fluidly connected to the trough by an adaptor 150 and a washer 152. A first elbow section 154 is connected to the adaptor 150 by an adaptor coupling 156 at one end thereof, and to a downspout elbow 158 by an elbow coupling 160 at the other end thereof. The downspout elbow 158 is connected at one end to the elbow coupling 160 and at the other end to a bottom downspout section 162 by a downspout coupling 164. A bottom elbow 166 is integral with the bottom downspout section 162 and directs drainage water away from the post 14 to which the downspout system 40 is connected by clip bands 168 and 170 encircling the bottom downspout section 162 and fastened to the post 14.

Figure 6:
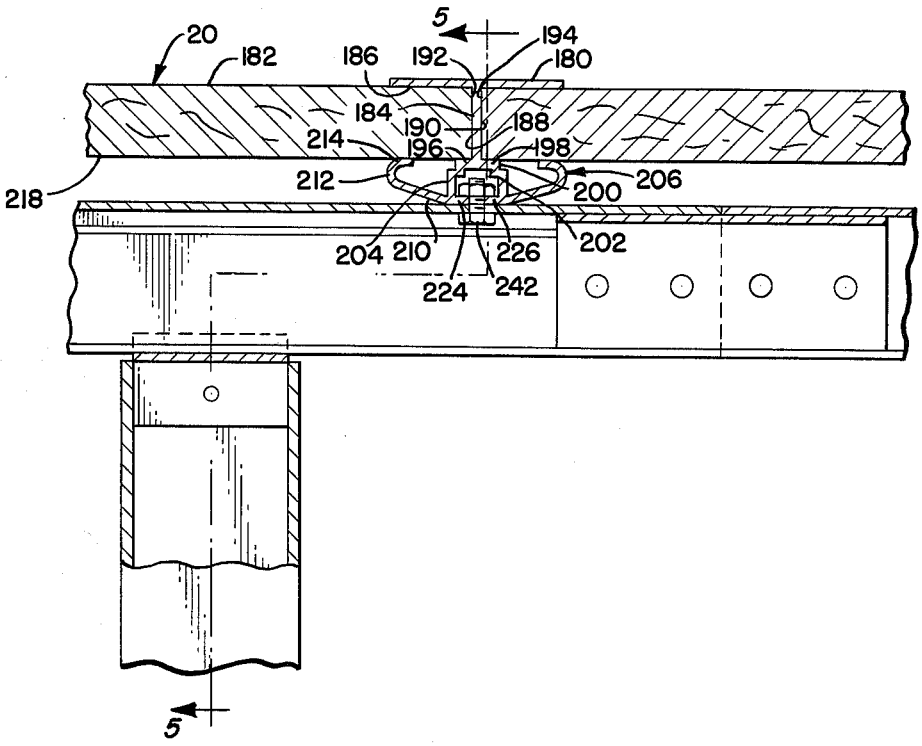
FIG. 6 is an elevation view taken along line 6—6 of FIG. 5.

As best shown in FIGS. 1 and 6, the joining ribs 26 are elongate and essentially co-extensive with the panels 20. The ribs are connected to the lateral side edges of the panels and serve to join together adjacent panels.

The ribs are integral and each include a top flange 180 adapted to contact top surface 182 of the panels when the panels are installed to form the awning. A central web 184 depends downwardly from the bottom surface 186 of the top flange 180 and has side faces 188 and 190 adapted to abut end surfaces 192 and 194 of the adjacent installed panels.

A pair of oppositely presented offset segments 196 and 198 extend horizontally outward from the faces 188 and 190, respectively. The offset segments are essentially parallel with top flange 180 and are spaced apart therefrom a distance approximately corresponding to the thickness of the panels to form a keeper slot therewith to lock the panels to the rib.

A setback segment 200 depends vertically from the outer edge of each offset segment and a connecting segment 202 connects each setback segment to a base 204 of one of a pair of wing sections 206. The connecting segments are horizontal and the bases 204 of the wing sections are vertically oriented, as shown in FIG. 6.

The bases 204 are each connected at the top edge thereof to the corresponding connecting segment outer edge and at the bottom edge thereof to an upwardly inclined portion 210 which is integral therewith and has a U-shaped outermost edge 212. The edges 212 each have a short leg 214 turned inwardly toward the web of the rib 26 to form a supporting surface 216 on the outer surface of the U-shaped end short leg. The length and angle of inclination of the inclined portions are selected so that supporting surfaces 216 are coplanar with offset segments 216 and contact undersurface 218 of the awning panels 20. The wings thus serve as further supporting members for the awning panels, see FIG. 4.

Tail forming flanges 224 and 226 are integrally attached to the ribs at the bottom edges of each of the vertical bases 204. The tail flanges are horizontal and extend inwardly of the bases 204 and have inner terminal edges 230 spaced apart to define a slot 232 therebetween. The tail flanges are coplanar and, together with the setback segments and offset segments, define a channel 234.

The channel 234 is sized to accommodate nut 236 in free sliding engagement along the longitudinal direction of the channel, and the slot 232 is sized to accommodate bolt shank 238 of bolt 92 or 102 in free sliding engagement. However, the slot 232 has a width less than the width of nut 236 to support same on top surfaces 240 of the tail flanges.

As shown in FIG. 6, the bolt 92 or 102 has a head 242 located on the undersurface of either the spanner segment or the gutter mounting bracket, respectively.

Therefore, as shown in FIG. 1, the bolts can be loosely connected to the appropriate nuts and the nut guided into channel 234 to hang the spanner and gutter on the rib joints. The channel 234 is sized so that the nuts cannot twist, and thus, once the just-discussed hanging procedure is completed, the bolts can be turned to take up the nuts and tightly connect the elements together. Once this is completed, the spanner segments can be quickly connected to the support posts.

By comparing FIGS. 2 and 4–6, it can be seen that the captive nut assembly including the bolts, nuts and channels permits fast and easy installation of the awning. The rib joints thus serve a dual purpose of joining the panels together and providing a trackway into which the nuts are fit to quickly position the awning elements with respect to each other. An awning can thus be quickly erected, but can also assume various configurations because the nuts can assume a wide variety of longitudinal positions within the rib joint channels.

Figure 3:
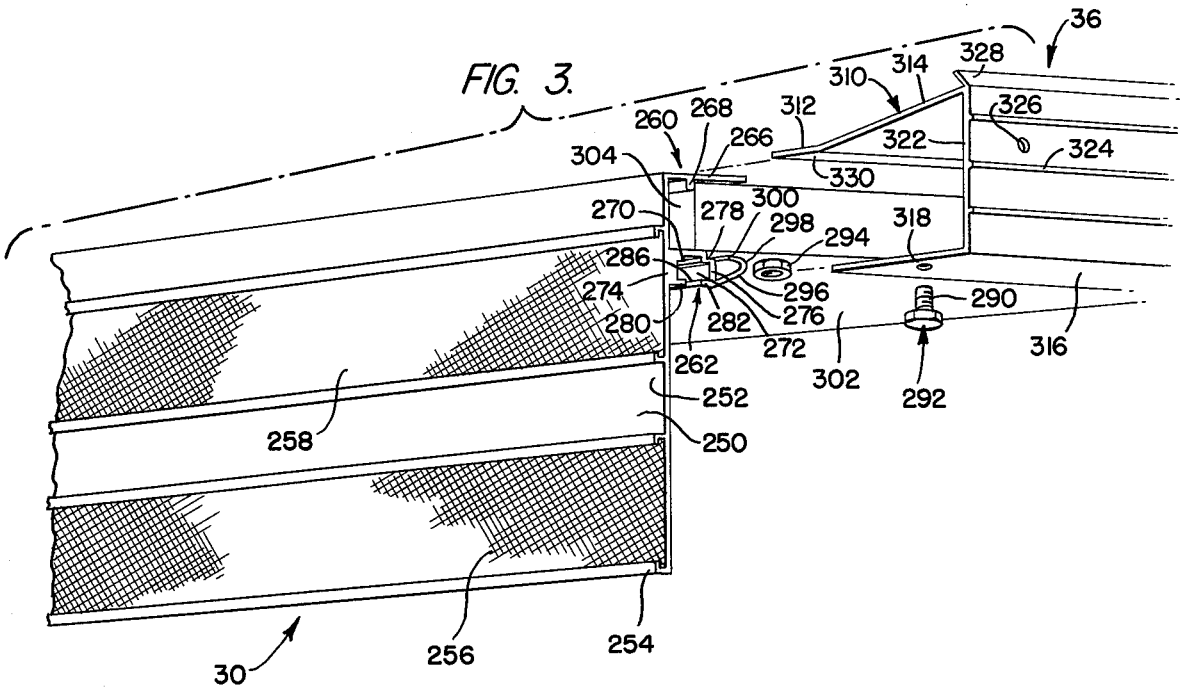
FIG. 3 is a perspective of an end edge detail of the awning assembly embodying the teachings of the present invention.
Figure 4:
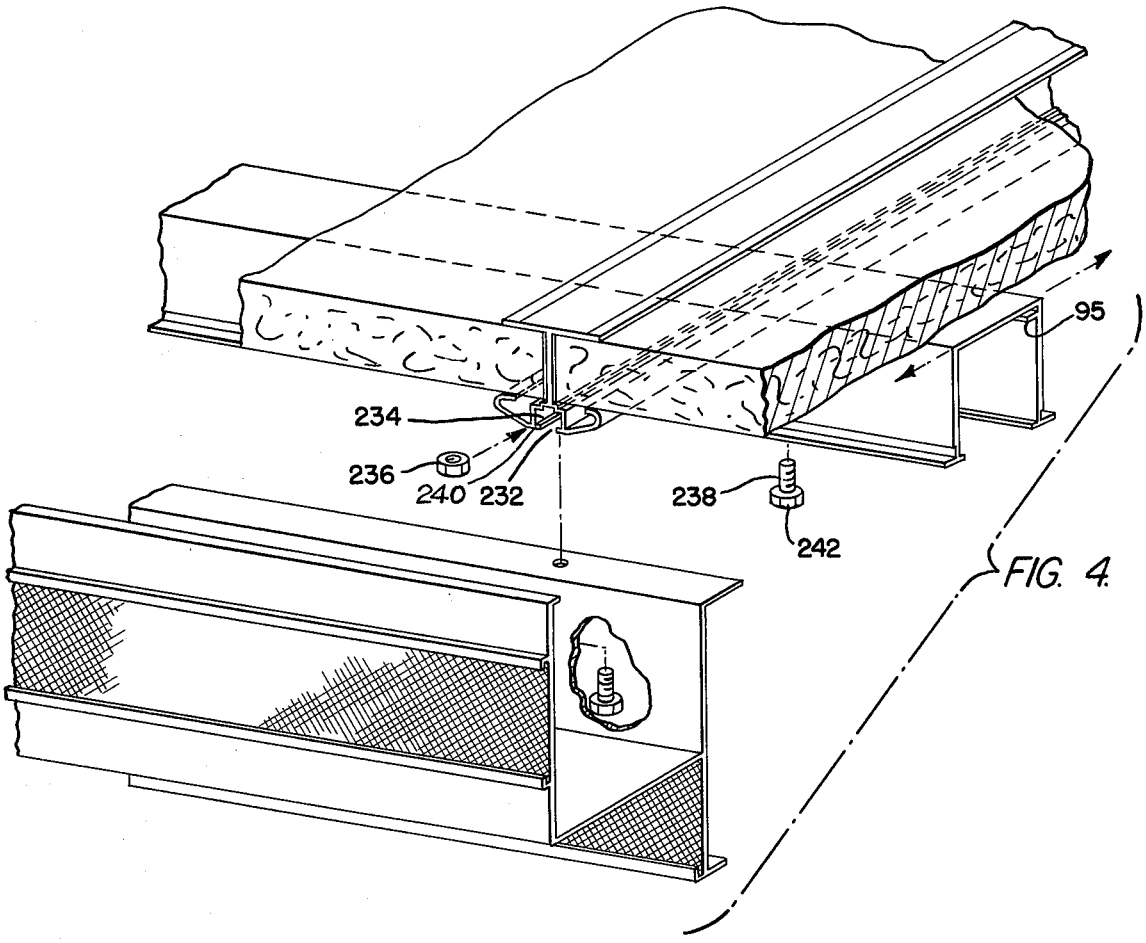
FIG. 4 is an exploded perspective of a front edge detail of the awning assembly embodying the teachings of the present invention.

As best shown in FIGS. 2 and 3, the side trim 30 borders the awning on the lateral sides thereof. The trim includes a pair of skirt-like brackets 250 each pendently supported on an endmost panel of the awning. Front surface 252 of the bracket has pairs of cuff-defining catches 254 similar to the cuffs located on the gutter, and support spaced apart feature strips 256 and 258 in a manner similar to the feature strips 120 and 136.

The trim has channel-defining flange members 260 and 262 integrally attached thereto at the upper end thereof. The flange members are shaped similarly to the rib joint flange members and include an upper plate member 266 having a depending stop element 268 thereon and a lower shelf-like support ledge 270. The ledge 270 includes a channel 272 defined by spaced sides 274 and 276 which each have longitudinally extending offset portions 278 at the top end thereof and inwardly directed horizontal lips 280 and 282 on the lower ends thereof. The lips are horizontally spaced apart to define a longitudinally extending slot 286 therebetween. The slot is sized to receive the shank portion 290 of a locking bolt 292 in a free sliding manner, and are close enough together to support nut 294 on the upper surface of the lips in a non-twisting manner. An upwardly inclined segment 296 extends from the bottom outside surface of side 276 and has a hook end 298 integrally formed at the outer end of the segment. Upper surface 300 of the hook end contacts under surface 302 of an end panel to support same. The stop element 268 abuts the end 304 of the end panel and positions that panel with respect to the trim 30. The panel is slidingly inserted into the panel accommodating channel defined by spaced apart elements 266 and 270 to support the trim 30 in the desired position on the awning.

As can be seen, the universal nature of the panels and the trim elements provides for quick and easy addition of, or removal of, side panels to vary the width of the awning assembly.

Also shown in FIG. 3 is the elongate mounting rail 36 which is channel-like in shape and includes a top flange 310 having a longitudinally extending tip section 312 integrally joined to inclined section 314. A bottom flange 316 is planar and has a plurality of longitudinally spaced apart bolt receiving holes 318 defined therein. A bight-like element 322 connects the top and bottom flange and has a plurality of longitudinally extending, spaced apart ribs 324 thereon, and a plurality of longitudinally spaced apart fastener receiving holes 326 defined therein. An upper canted strip 328 extends longitudinally of the rail. The tip section is spaced apart from the bottom flange a distance approximately equal to the thickness of the awning panels 20, and the lower surface 330 of the tip section contacts the upper surface of the panel so that the panel is snugly held in place in the rail channel. A fastener, such as bolt 292, releasably connects the rail to the trim channel, and other fasteners fit through the holes 326 to connect the rail to the home or structure.

The ribs 324 provide condensation controlling channels, and the strip 328 prevents moisture from the awning from running behind the rail 36.

Figure 7:
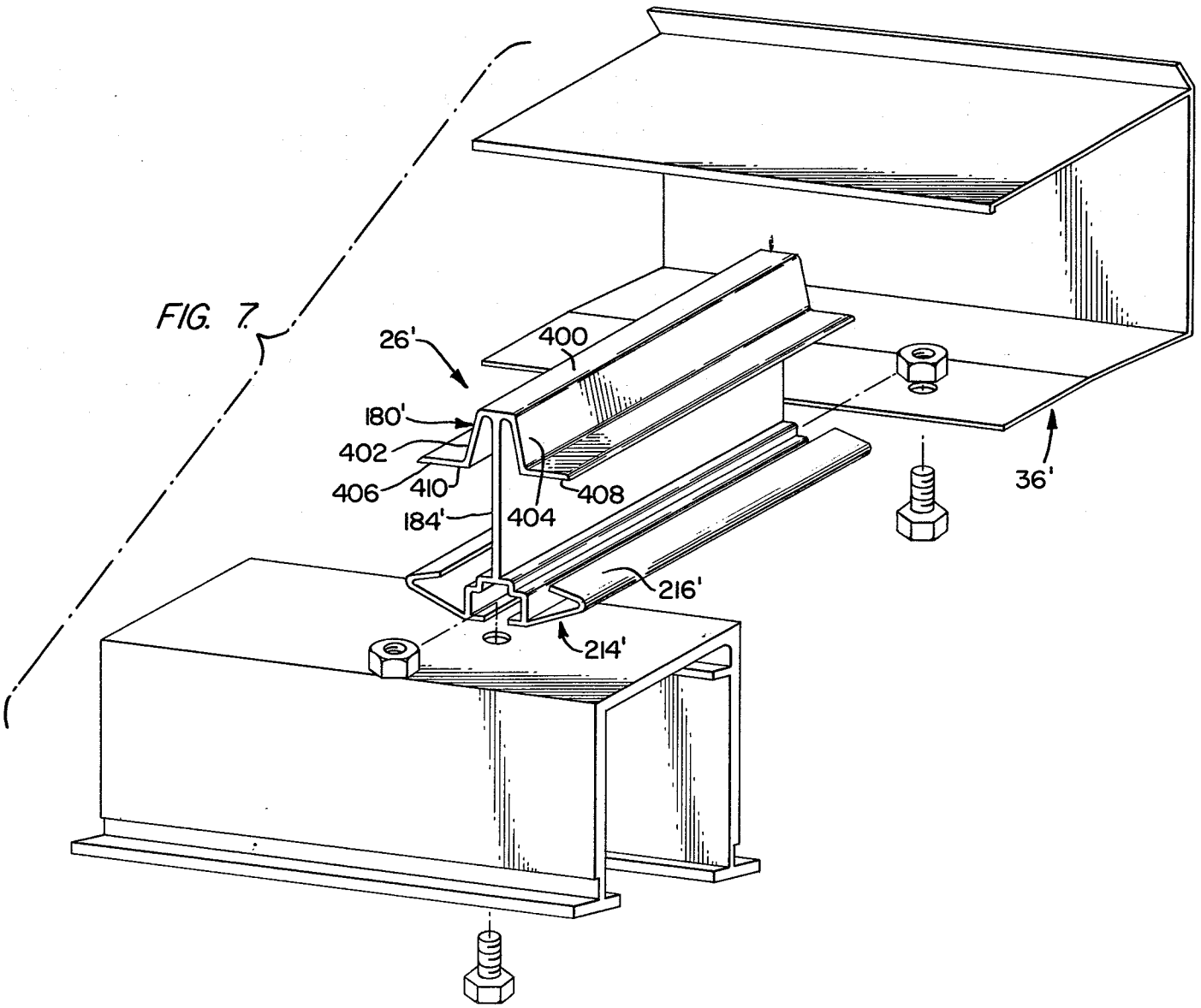
FIG. 7 is an exploded perspective of an alternative embodiment of a panel rib used in the awning assembly embodying the teachings of the present invention.

An alternative embodiment of the rib 26 is shown in FIG. 7 and is denoted by the numeral 26'. The rib 26' is used whenever load-carrying capacities of the awning assembly are to be increased over that of the assembly incorporating rib 26. Such increased load-carrying capacities might be desirable in the snow-belt. The awning assembly incorporating rib 26' has been found to increase the load-carrying capacities of the awning assembly by approximately 60%.

Rib 26' has an integral top flange 180' which includes a top section 400 which extends horizontally outward from central web 184'. A pair of inclined wings 402 and 404 depend from the outer tips of the top section and a pair of outer horizontal flanges 406 and 408 extend from the lower tip of the wings outwardly away from the central web 184'. Both the wings and the horizontal flanges extend longitudinally of the rib 26'. The bottom section of rib 26' is identical to the bottom section of rib 26.

The spacing between lower surface 410 of the horizontal flanges and the supporting surface 216' of the short leg 214' is selected to accommodate awning panels 20. The mounting rail 36' is similar to mounting rail 36, except that it is formed to accommodate loads heavier than those loads accommodated by rail 36.

In the preferred embodiment, rib 26' is formed from rib 26 by increasing the awning panel rib central web section height by five eighths inches, turning a portion of the top flange down at a 15° angle, and then turning the top flange legs back to the horizontal to define the horizontal flanges. In the preferred embodiment, the spacing between surfaces 410 and 216' is 1.040 inches to accommodate the awning panel 20.

An awning assembly incorporating rib 26' is assembled in a manner similar to an assembly incorporating rib 26.

As shown in FIG. 7, $\frac{1}{4}$20 nuts and $\frac{1}{4}$20 × $\frac{3}{8}$inch bolts are used.

Erection of the awning assembly 10 is very quick and easy due to the versatility provided by the captive nut assemblies formed by the channels on the joining ribs and trim strips.

Preferably, materials such as aluminum extrusions and thermal barrier plastics are used for appropriate elements. Thus, all primary supporting members are aluminum extrusions designed and alloyed for their specific use to obtain maximum support strength. These supporting members include the back rail 36; the spanner, or front supporting channel; the spanner joiner members; the support posts; the post top clips; the joining ribs; and the side trim. Further, members not directly contributing to the support of the awning, but which are also extruded, include the gutter member, the gutter joiner members, the gutter end caps, the downspout system members (including the elbows, couplings, adaptor and clip bands 42). The adaptor and couplings are preferably plastic.

Preferably, the roof panels are 1 inch thick and 23$\frac{7}{8}$ inches wide and have a core of polystyrene having a density of 2 pounds per cubic foot, and 0.030 inch thick polystyrene skins bonded to the top and bottom of the panel. The thermal barrier awning is therefore rigid, insulated and maintenance free.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A roof comprising:

a plurality of elongate panels;

supporting means including support posts and roof supporting means connected on said posts for supporting said panels;

a plurality of elongate connecting means on the lateral edges of said panels for connecting adjacent panels together, said connecting means including a top flange adapted to contact a top surface of each adjoining panel connected by said each connecting means, a web member projecting downwardly from said top flange to contact a peripheral end edge surface of the adjacent ends of each of said adjoining panels, and a bottom flange adapted to contact a bottom surface of each of said adjoining panels, said connecting means bottom flanges each including a first horizontal segment attached at one side to said web, a vertical segment having one side thereof connected to another side of said horizontal segment, a second horizontal flange attached at one side thereof to another side of said vertical segment and extending toward said web for defining a fastener receiving channel, an inclined segment attached at one side thereof to said vertical segment another side and angling outwardly and upwardly from said vertical segment another side, a U-shaped segment having one leg thereof connected to another side of said inclined segment and another leg thereof extending towards said web and being essentially coplanar with said first horizontal segment to contact the undersurface of one of said panels; and a plurality of fastener means connecting said connecting means to said roof supporting means, said fastener means each including a nut received in one of the channels defined by said channel defining means.

2. A roof comprising:

a plurality of elongate panels;

supporting means including support posts and roof supporting means connected on said posts for supporting said panels;

a plurality of elongate connecting means on the lateral edges of said panels for connecting adjacent panels together, said connecting means each including a top flange adapted to contact a top surface of each adjoining panel connected by said each connecting means, a web member projecting downwardly from said top flange to contact a peripheral end edge surface of the adjacent ends of each of said adjoining panels, and a bottom flange adapted to contact a bottom surface of each of said adjoining panels, said connecting means bottom flanges each including a first horizontal segment attached at one side to said web, a first vertical segment attached at one side to another side of said first horizontal segment, a second vertical segment attached at one side to another side of said first vertical segment, a second horizontal flange attached to another side of said second vertical segment to extend toward said web for defining a fastener receiving channel with said vertical and horizontal segments, an inclined segment attached at one side to said second vertical segment another side, said inclined segment angling outwardly and upwardly from said second vertical segment another side, and a U-shaped segment having one leg connected to another side of said inclined segment and another leg extending towards said web and being essentially coplanar with said first horizontal segment to contact the undersurface of one of said panels; and a plurality of fastener means connecting said connecting means to said roof supporting means, said fastener means each including a nut received in one of the channels defined by said channel defining means.

3. The roof of claim 1, further including a plurality of ground anchor means mounting said posts in the ground.

4. The roof of claim 1, wherein said supporting means include extender members for coupling adjacent supporting means together in an end-to-end manner.

5. The roof of claim 1, further including elongated side trim panels mounted on the lateral edges of end-most roof panels and each including a longitudinal channel defining member for receiving a nut of a fastener means.

6. The roof of claim 1, further including gutter forming means attached to said panels via fastener means located in said channels.

7. The roof of claim 6, further including drainage means fluidly connected to said gutter forming means and supported on one of said support posts.

* * * * *